United States Patent [19]

Tahara et al.

[11] 4,362,375

[45] Dec. 7, 1982

[54] APPARATUS INCLUDING A CIRCULATING CHAIN FOR CONVEYING PHOTOSENSITIVE MATERIAL

[75] Inventors: Toshiro Tahara; Izumi Seto, both of Minami-ashigara, Japan

[73] Assignee: Fuji Photo Film Co., Ltd., Kanagawa, Japan

[21] Appl. No.: 269,215

[22] Filed: Jun. 2, 1981

[30] Foreign Application Priority Data

Jun. 9, 1980 [JP] Japan ..... 55-80164

[51] Int. Cl.[3] ..... G03D 3/08

[52] U.S. Cl. ..... 354/320; 226/92; 198/473; 198/577

[58] Field of Search ..... 354/316, 319, 320, 321, 354/322, 344; 134/64 P, 122 P; 226/92, 189; 198/473, 571, 572, 573, 577, 856

[56] References Cited

U.S. PATENT DOCUMENTS 2,980,006 4/1961 Nieuwenhoven et al. ..... 354/322

4,208,119 6/1980 Spence-Bate ..... 354/322

FOREIGN PATENT DOCUMENTS 53-29916 8/1978 Japan ..... 354/321

*Primary Examiner*—Russell E. Adams

*Assistant Examiner*—Alan Mathews

*Attorney, Agent, or Firm*—Sughrue, Mion, Zinn, Macpeak and Seas

[57] ABSTRACT

Apparatus for processing photosensitive material including a guide bar to which one end of the photosensitive material such as a film strip is attached, a circulating chain which carries the guide bar and which is grasped by a link plate, and a rachet wheel which delivers the guide bar between the rachet wheel and the circulating chain. The rachet wheel is mounted on a drive therefor through an elastic material so that the torque for the drive shaft is elastically transmitted to the rachet wheel when the guide bar is delivered between the rachet wheel and the chain. With this arrangement, it is always possible to smoothly transfer the guide bar between the rachet wheel and the chain without jamming of the apparatus.

7 Claims, 6 Drawing Figures

APPARATUS INCLUDING A CIRCULATING CHAIN FOR CONVEYING PHOTOSENSITIVE MATERIAL

BACKGROUND OF THE INVENTION

The present invention relates to an apparatus for processing photosensitive material of what is called a "chain-carried" type in which a guide bar to which one end of a photosensitive material is fixed is handed over to a chain which is arranged in such a way as to circulate in a treatment bath. The guide bar is then carried and guided into the bath for treatment.

An apparatus for processing photosensitive material of the "chain-carried" type is for example, disclosed in Japanese Published Patent application No. 29916/1978. FIG. 1 is a side elevation view showing this apparatus. In this apparatus, a chain 2 having outwardly projected link plates 1 which pass over sprocket wheels 3 and 4 is arranged to circulate in a bath 5 for treatment. A guide bar 6 to which one end of a photosensitive material F is fixed is adapted to be handed over between the link plates 1 by a rachet wheel 7 and a guide 8. The guide bar 6 which is thus handed over is grasped with the link plate and sent along the guide 9. The photosensitive material F is moved by guide rolls 12 and 13 which are respectively supported by a shaft 10 of the ratchet wheel 7 and a shaft 11 of the sprocket wheel 4.

The sprocket wheel 3 for circulating the chain 2 and the ratchet wheel 7 are intended to rotate in synchronism with each other when the guide bar 6 is handed over from the ratchet wheel 7 to the link plate 1 or vice versa. However, the speeds of the sprocket wheel 3 and ratchet wheel 7 may vary and, as a result, the guide bar 6 can become clasped between the ratchet wheel 7 and the outer end of the link plate 1 as shown in FIG. 2 so that the guide bar 6 cannot be transferred from the ratchet wheel 7 to the link plate 1 or vice versa thus resulting in machine malfunction.

It is an object of the present invention to provide an apparatus for processing photosensitive material of the "chain-carried" type in which the guide bar is smoothly transferred between the ratchet wheel and the chain.

SUMMARY OF THE INVENTION

The above-mentioned object of the present invention is achieved by an apparatus for processing photosensitive material including a guide bar to which one end of a photosensitive material is fixed, a circulating chain which carries the guide bar which is engaged with a link plate, and a ratchet wheel which delivers the guide bar between the ratchet wheel and circulating chain. The ratchet wheel is mounted on its drive shaft through an elastic material so that the torque from the drive shaft is elastically transmitted to the ratchet wheel when the guide bar is delivered between the ratchet wheel and the chain.

DESCRIPTION OF THE PREFERRED EMBODIMENTS

The invention will be described in more detail with reference to a preferred embodiment and the accompanying drawings.

Figure 3:
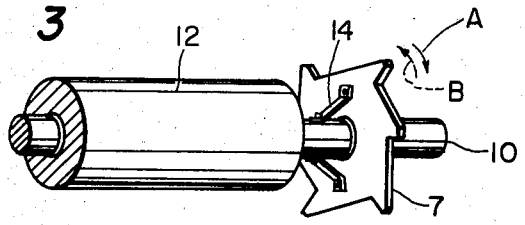
FIG. 3 through FIG. 5 are perspective views showing essential parts in preferred embodiments of an apparatus constructed in accordance with the present invention.

FIG. 3 is a perspective view showing essential parts of a preferred embodiment of an apparatus constructed in accordance with the present invention. A ratchet wheel 7 is mounted onto a drive shaft 10 so that torque from the drive shaft 10 is transmitted to the ratchet wheel in an elastic manner. To accomplish this, the ratchet wheel 7 is coupled to the drive shaft 10 through straps of an expansible elastic material 14 such as rubber or the like.

Figure 4:
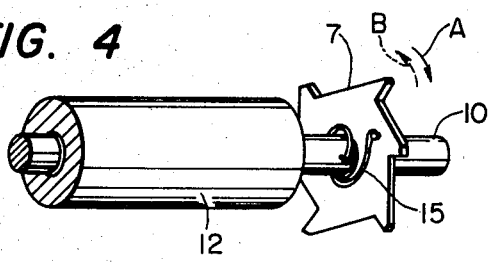
Figure 5:
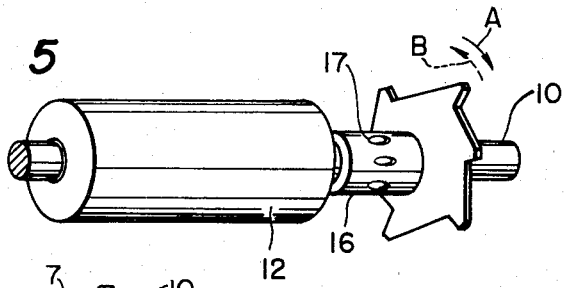

FIG. 4 shows another embodiment of the invention in which the ratchet wheel 7 is mounted on the drive shaft 10 via a spring 15 instead of the elastic material 14 as shown in FIG. 3. FIG. 5 shows still another embodiment wherein the ratchet wheel 7 is coupled to the driveshaft 10 via a tube 16 which is formed of rubber instead of using the elastic material 14 shown in FIG. 3. A plurality of holes 17 for adjustment are formed in the tube 16.

Figure 6:
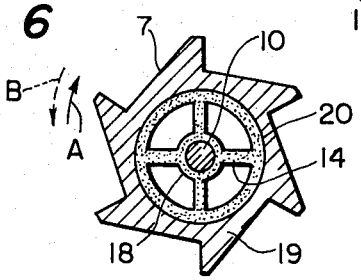
FIG. 6 is a cross-sectional view showing essential parts of another preferred embodiment in accordance with the present invention.

FIG. 6 is a cross-sectional view showing essential parts of an embodiment wherein the ratchet wheel 7 itself has a special structure. In this case, an elastic material 14 is interposed between the mounting portion 18 for the drive shaft 10 and the mounting portion 20 for the ratchet portion 19. In this embodiment as shown in FIG. 6, the mounting portions 18 and 20 and the elastic material 14 are integrally formed of rubber material. These members are fitted to the ratchet portion 19 and then the drive shaft 10 is inserted therein and attached.

Figure 1:
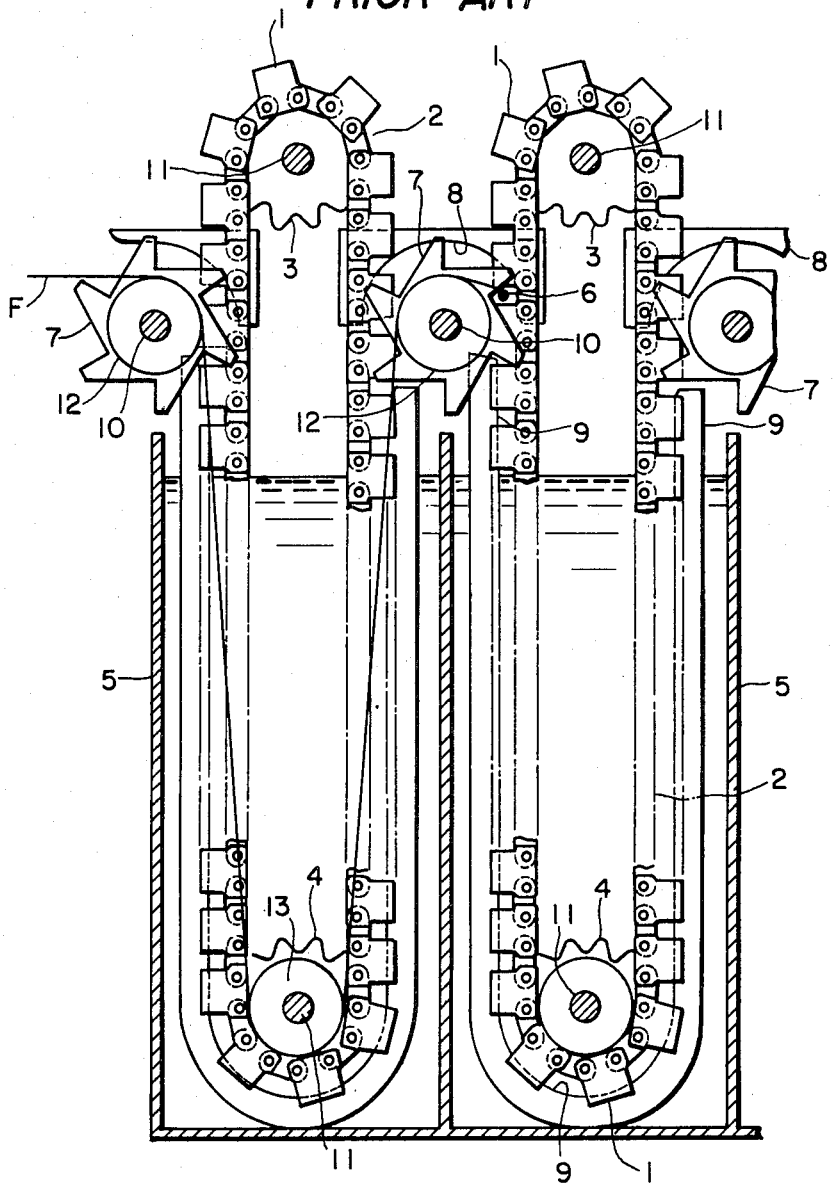
FIG. 1 PRIOR ART
FIG. 1 is a side elevational view of essential parts of a prior art apparatus for processing photosensitive material of a chain-carried type.
Figure 2:
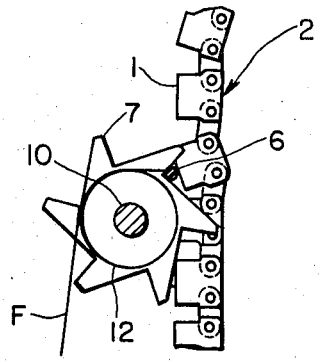
FIG. 2 PRIOR ART
FIG. 2 is a side elevational view of essential parts showing a relationship when a malfunction occurs in the apparatus of FIG. 1.

In all the embodiments shown in FIG. 3 through FIG. 6, the ratchet wheel 7 is usually turned in the direction indicated by the arrow A by means of the drive shaft 10. However, in case, for example, the ratchet wheel 7 is subjected to a heavy load due to engagement of the guide bar 6 with the link plate 1, prior to the occurrence of such a condition as shown in FIG. 2 wherein the guide bar 6 is handed over from the ratchet wheel 7 to the link plate 1 of the chain 2, the described construction of the ratchet wheel 7 results in a delay for rotation in the direction indicated by the arrow B relative to the rotation of the drive shaft 10. Due to the delay, it becomes possible to transfer the guide bar 6 from one link plate 1 to another link plate 1 without resulting in the condition as shown in FIG. 2. Therefore, with the use of the apparatus for processing photosensitive material of the invention as described above, it is possible to smoothly transfer the guide bar between the ratchet wheel and the chain and thereby eliminating problems which may occur if the photosensitive material is conveyed by the prior art apparatus described above.

What is claimed is:

1. In an apparatus for processing photosensitive material including a guide bar to which one end of a photosensitive material is fixed, a circulating chain which carries said guide bar which is grasped by a link plate, and a ratchet wheel which delivers said guide bar between said ratchet wheel and said circulating chain, the improvement comprising said ratchet wheel being mounted on a drive shaft through an elastic material, wherein torque from said drive shaft is elastically transmitted to said ratchet wheel when said guide bar is delivered between said ratchet wheel and said chain.

2. The apparatus of claim 1 wherein said elastic material comprises straps of rubber.

3. The apparatus of claim 1 wherein said elastic material comprises at least one spring.

4. The apparatus of claim 1 wherein said elastic material comprises a rubber tube.

5. The apparatus of claim 4 wherein a plurality of holes for adjustment are provided in said tube.

6. The apparatus of claim 1 wherein said elastic material comprises a first annular portion having an inside surface in contact with said drive shaft, a second annular portion having an outside surface in contact with said ratchet wheel and a plurality of spokes extending between said first and second portions.

7. The apparatus of claim 6 wherein said first and second portions and said spokes are integrally formed.

* * * * *